United States Patent [19]

Saito

[11] 4,366,220

[45] Dec. 28, 1982

[54] ELECTROSTATIC IMAGE RECORDING PROCESS USING PREHISTERESIS UNIFORM CHARGING AND LIGHT EXPOSURE PRETREATMENT

[75] Inventor: Itaru Saito, Toyokawa, Japan

[73] Assignee: Minolta Camera Kabushiki Kaisha, Osaka, Japan

[21] Appl. No.: 245,751

[22] Filed: Mar. 20, 1981

[30] Foreign Application Priority Data

Mar. 27, 1980 [JP] Japan ..... 55-40029
Aug. 22, 1980 [JP] Japan ..... 55-116281

[51] Int. Cl.[3] ..... G03G 13/22

[52] U.S. Cl. ..... 430/31; 430/54; 430/55; 430/94 S; 430/94; 355/3 TE

[58] Field of Search ..... 430/53, 131, 94 S, 55, 430/50, 34, 35, 94, 54; 355/3

[56] References Cited

U.S. PATENT DOCUMENTS 3,533,783 10/1970 Robinson ..... 430/31 X
4,105,324 8/1978 Seil ..... 355/11
4,175,955 11/1979 Semo et al. ..... 430/3 S

FOREIGN PATENT DOCUMENTS 49-4337 1/1974 Japan ..... 430/54
1573127 8/1980 United Kingdom .

*Primary Examiner*—John D. Welsh
*Attorney, Agent, or Firm*—Watson, Cole, Grindle & Watson

[57] ABSTRACT

An image-forming method suitable particularly for copying using image exposure wavelengths of 700 to 850 nm such as are experienced with semiconductor laser beam printers. Useful photosensitive members include photoconductive layer prepared from a dispersion of a photoconductive material including at least cadmium sulfide in a resin binder. The photosensitive member is sequentially subjected to a plurality of prehysteresis operations, each comprising electrostatically charging the member and uniformly exposing the same to light until the photosensitivity of the photosensitive member has been substantially stabilized.

10 Claims, 8 Drawing Figures

ELECTROSTATIC IMAGE RECORDING PROCESS USING PREHISTERESIS UNIFORM CHARGING AND LIGHT EXPOSURE PRETREATMENT

BACKGROUND OF THE INVENTION

1. Field of the Invention:

The present invention relates to an image-forming method, and more particularly to an image-forming method which is suitable for copying and which utilizes a semiconductor laser and a photosensitive member, the photosensitive member comprising a conductive substrate which has a photoconductive layer formed thereover, the photoconductive layer having been prepared from a dispersion of a photoconductive material.

2. Description of the Prior Art:

In recent years, laser beam printers capable of handling information at high speed have been introduced into use. Such printers use a visible ray laser, such as a He-Ne gas laser or the like. A selenium-containing photoconductive layer is widely employed as the photosensitive member to take advantage of its excellent photosensitivity. On the other hand, laser printers using a semiconductor laser as an exposure light source have also been introduced into use. The use of such semiconductor lasers facilitates making the printer smaller in size and simpler to modulate. However, because the wavelength for semiconductor lasers is very near the infrared zone, the photosensitive member often experiences photo-fatigue, which is caused by the illumination light, and its charge-accepting capability during exposure is thus degraded when selenium-containing photoconductive layers are used.

Accordingly, for laser beam printers using semiconductor lasers as the light source, or for copying apparatuses which utilize light wave lengths near the infrared zone in the image-forming sensitive stages, there is a need for a photosensitive member which is free of the above-mentioned photo-fatigue and which is stable under repeated exposure, as well as a need for an image-forming method capable of producing a satisfactory image.

It is accordingly a primary object of the present invention to provide a novel and improved image-forming method whereby the photosensitive member is free from photo-fatigue over an extended period of time and is capable of use under conditions requiring high sensitivity.

Another object of the present invention is to provide an image-forming method which is particularly suitable for copying using exposure conditions near the infrared wavelength zone.

Still another object of the present invention is to provide an improved image-forming method wherein a semiconductor laser beam printer is suitably used and wherein satisfactory images are produced at high speed using long wavelengths of about 700 to 850 nm in the exposure process.

SUMMARY OF THE INVENTION

These and other objects of the present invention are achieved by providing an image-forming method wherein a photosensitive member is employed which comprises a conductive base that has a photoconductive layer formed thereover which has been formed from a dispersion of a photoconductive material that includes at least cadmium sulfide in a resin binder. The method comprises sequentially subjecting the photosensitive member to a plurality of prehysteresis operations, each comprising electrostatically charging the member and thereafter uniformly exposing the same to light, and subsequently forming an electrostatic latent image thereon.

For a fuller understanding of the nature and objects of the present invention, reference is made to the following detailed description, which should be taken in conjunction with the accompanying drawings.

DESCRIPTION OF THE PREFERRED EMBODIMENTS

Figure 1:
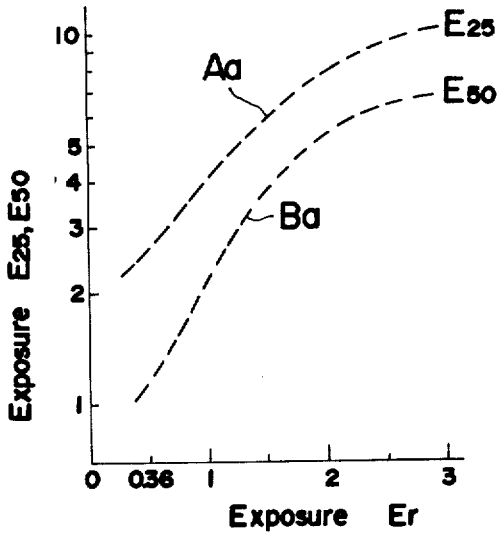
FIGS. 1 to 4 are graphs showing respectively the dependency of photosensitivity of the photosensitive member relative to the amount of exposure by a light eraser when $CdS{\cdot}nCdCO_3$, $CdS_xSe_{1-x}{\cdot}nCdCO_3$, CdS or $(CdS)_x(CdSe)_{1-x}{\cdot}nCdCO_3$ is used as the photoconductive material in the photosensitive member.

A photosensitive member suitable for use in the present invention includes a conductive substrate such as aluminum, preferably in a form of drum, a photoconductive layer formed over the substrate and only if necessary, an insulating protective layer formed over the photoconductive layer. Photoconductive materials for the photoconductive layer should include at least cadmium sulfide. In particular, the photoconductive material is preferably selected from the group consisting of (1) $CdS_xSe_{1-x}{\cdot}nCdCO_3$ ($0.1 \leqq x \leqq 1$; $0 < n \leqq 4$), (2) CdS and (3) $(CdS)_x(CdSe)_{1-x}{\cdot}nCdCO_3$($0.1 \leqq x \leqq 0.99$; $0 < n \leqq 4$). As may be apparent, photoconductive material (1) is represented by the formula $CdS{\cdot}nCdCO_3$ when x equal 1.

The photoconductive layer is formed by a dispersion of one of the above-desired photoconductive materials in a resin binder which is then coated onto the conductive substrate in a thickness of about 10 to 60 microns. The coating is then heat cured. Any kind of resin binder may be used as long as it is heat curable, and the same may suitably be selected from one or a combination of acryl resins, amino resins, epoxy resins, silicone resins, fluorine resins, polyester resins and vinyl resins. If desired, a small amount of an activator such as copper, silver or halogen and a stearate metallic salt such as manganese stearate may be added to the photoconductive layer.

In addition, the photosensitive member suitable for use in accordance with the present invention may include a light transparent insulating protective layer covering the photoconductive layer. Such a protective layer preferably will be characterized by suitable surface smoothness, surface hardness and mechanical strength, and should be effective to prevent occurrence of what is known as filming phenomenon, resulting in image contamination caused by the tendency of residual toner to become buried in the photosensitive member when an elastic blade in contact with the surface of the photosensitive member is used as a residual toner removing means. As the material for this protective layer, any one or more of the above-mentioned thermally curable resins can be used, and the thickness thereof may be about 0.05 to 5 microns. Silicone additives may be added to reduce the frictional coefficient of the protective layer.

Photosensitive members of the type mentioned above have very good mechanical properties with respect to surface hardness and abrasion resistance, and the same are resistant to heat and moisture. Moreover, such photosensitive members permit the use of semiconductor laser beam printers since they have photosensitivity, not only in the visible ray zone, but also to rays near the infrared zone. And they are also less retentive of a residual potential. In addition, this type of photosensitive member has the peculiar characteristic of being capable of sensitization to improve the photosensitivity thereof to a certain degree by the image-forming method of the present invention. Thus the same are quite suitable for use in accordance with the present invention.

It has been found, in accordance with the present invention, that photosensitive members comprising a photoconductive layer including at least cadmium sulfide provide a unique prehysteresis effect. More specifically, although the charge-accepting capability of the photosensitive member is always the same regardless of prehysteresis, i.e., as long as the charging conditions are consistent, a prehysteresis effect is exhibited in which the light decay characteristics from the same surface potential varies relative to the prehysteresis. Accordingly, when the above-mentioned photosensitive member is used in a copying apparatus in which at least a portion of the photosensitive member is used repeatedly for completing a single copy, the front half of the copy image corresponding to the first revolution of the photosensitive drum then becomes fogged (front half fogging or first drum rotation effect), or the front half (corresponding to the first rotation of the drum) of the image overlaps the latter half of the copy image corresponding to the repeatedly used portion of the drum (memory effect). Thus the copy image is stained.

These phenomena are attributable to (1) the presence of various impurities in the finely divided photoconductive materials, including at least cadmium sulfide, which form the photoconductive layer of the photosensitive member of the type mentioned, (2) the imperfections, such as lattice defects and lattice irregularities, in the material, and (3) the presence of numerous sites (hereinafter referred to as "traps") for capturing charge carriers (hereinafter referred to simply as "carriers"), which sites or traps are formed at the interfaces between the fine particles of the photoconductive material or between the material and the binder resin. More specifically stated, since carriers produced by the charging-image projection process during the first rotation of the drum fill traps, carriers similarly produced during the second rotation of the drum have a prolonged average lifetime $\tau_T$ before being captured in traps, consequently giving higher photosensitivity to the photosensitive member during the second rotation of the drum than during the first rotation. This leads to front half fogging. Furthermore, there is a difference in the degree of trap filling between the non-image areas (illuminated areas where carriers are produced) on the drum and the image areas (unilluminated areas where no carriers are formed) during the first rotation of the drum, with the result that the photosensitivity of the drum during the second rotation differs from location to location relative to the image pattern on the drum during the first rotation, consequently producing a memory effect.

The stains on copy images, such as front half fogging due to the unevenness in the rate of trap filling with respect to time and to the memory effect due to the unevenness in the degree of trap filling with respect to location, can be prevented by releasing carriers from traps to empty the traps every time the drum is driven one turn, e.g., by using a residual charge eraser of sufficiently high illumination. For this purpose, U.S. Pat. No. 4,175,955 has proposed an erasing process which uses optical means of very high intensity illumination of greater than $10^3$ Lux for the photosensitive member which comprises $CdS \cdot nCdCO_3$.

Although the process disclosed in U.S. Pat. No. 4,175,955 is highly effective for copying apparatus which requires clear reproduction of half-tone when the erasing is performed during every image-forming step, it is rather ineffective for use in connection with a laser beam printer or with a copying apparatus used exclusively for line image reproduction wherein reproduction of half-tone images is not required. This is particularly true when one considers the fact that the photosensitive members useful for the present invention have relatively low sensitivity near the infrared zone as compared with the visible ray zone, so that the amount of exposure necessary for image exposure becomes quite high as compared with the case using the visible ray zone. At any rate, photosensitive members useful in the present invention have the above-described prehysteresis effect, and in this regard the present invention proposes an image-forming method effective for copying apparatus and laser beam printers which employ light wavelengths near the infrared zone for image formation.

The present invention will now be described with reference to the following examples.

PHOTOSENSITIVE MEMBER A

Here, a resin binder type photosensitive member using $CdS \cdot nCdCO_3$ ($n=1$) as the photoconductive material was prepared.

An aqueous solution containing 308.5 grams of cadmium nitrate and 0.16 grams of cupric chloride was admixed with an aqueous solution of ammonium carbonate to form a precipitate of $CdCO_3(Cu)$. The precipitate was dispersed in an aqueous solution of hydrogen sulfide to form a precipitate of $CdS\ (Cu) \cdot nCdCO_3(Cu)$. Subsequently, the precipitate was rinsed, dried, ground and calcined at a temperature of 250° C. for 15 hours to obtain a fine, photoconductive powder. The fine powder was then dispersed in a solution of 90 grams of thermosetting acrylic resin (Acrylic A 405 available from Dainippon Ink Co.) and 250 milliliter of an organic solvent mixture consisting chiefly of xylene together with 2 parts by weight of manganese stearate per 100 parts by weight of the powder. The mixture was thoroughly kneaded and applied by spraying onto an aluminum drum, 120 mm in diameter. Thereafter the mixture was cured with heating to prepare a photosensitive member A in the form of drum comprising a photoconductive layer about 30 microns in thickness.

Using the photosensitive member A, experiments were conducted to observe the characteristics of the photosensitive member in relation to the prehysteresis effect. The results obtained revealed that the photosensitivity of the photosensitive member A was increased (i.e., sensitized) by reducing the amount of exposure Er in the light illuminating step. This will be explained more in detail with reference to FIG. 1, which shows the relationship between the amount of erasing exposure Er and the photosensitivity of the photosensitive member A. In the drawing, the amount of erasing exposure Er (lux·sec) expressed in terms of logarithmic value is plotted as the abscissa and the amount of exposure (expressed in terms of relative value) required to light decay an initial surface potential $V_0$ of 600 volts on the photosensitive member A to 25% ($E_{25}$) and 50% ($E_{50}$) of $V_0$, respectively as the ordinate. Curve Aa being the characteristic for the amount of exposure $E_{25}$ and curve Ba the characteristic for $E_{50}$. As will be apparent in connection with FIG. 7, experiments were conducted by first exposing the rotating photosensitive member to a light eraser 7 under an exposing amount Er, charging by corona charger 8 to the surface potential $V_0$ and then exposing the charged photosensitive member to an exposure source 1 having an exposing wavelength of 820 nm, near the infrared zone as the photosensitive member is rotated at a constant speed. As the light eraser 7, a tungsten lamp source was used.

As shown by curve Aa in FIG. 1, when the photosensitive member is given an erasing exposure amount Er of $10^3$ lux·sec (logarithmic value of 3) by the light eraser 7 and is then charged to the initial surface potential $V_0$ of 600 volts, the amount of image exposure necessary to light decay the surface potential $V_0$ of 600 volts to 25% thereof, i.e., to 150 volts, is about 10, expressed in term of relative value. On the other hand, the amount of image exposure $E_{25}$ necessary is only about 2.3 when the photosensitive member is given the erasing exposure amount of Er of 2.3 lux·sec (logarithmic value of 0.36) prior to the charging. Similarly, the amount of image exposure $E_{25}$ necessary to light decay the surface potential of 600 volts to 25% thereof is about 4 when the erasing exposure amount Er of 10 lux·sec (log. 1) is given. Accordingly, photosensitive member A becomes more sensitive as the amount of erasing exposure Er is made smaller in order to light decay the initial surface potential to 25% of its value. Curve Aa indicates that when erasing exposure amounts of $10^3$ lux·sec and 2.3 lux·sec are compared, the photosensitive member A is sensitized more than four-fold since the amounts of image exposure $E_{25}$ required were 10 (relative value) in the case of Er of $10^3$ lux·sec and only about 2.3 in the case of Er of 2.3 lux·sec. Similarly, the photosensitive member is sensitized 2.5 fold when erasing exposure amounts of $10^3$ lux·sec and 10 lux·sec are compared.

To light decay the initial surface potential $V_0$ of 600 volts of 50% thereof, the amount of image exposure $E_{50}$ of about 7 in relative value is needed when the erasing exposure amount Er given is $10^3$ lux·sec, whereas only about one seventh (i.e., relative value of 1) thereof is needed when the amount of erasing exposure Er is 2.3 lux·sec. This means that the photosensitive member is sensitized as much as seven-fold. Since sensitization of at least twice as much is effective for the image-forming method of the present invention described herein, the amount of erasing exposure Er by the light eraser should preferably be about 2 to 20 lux·sec for photosensitive member A. It should be noted that with an amount of less than 2 lux·sec, the surface potential $V_0$ charged becomes unstable and accordingly is not desirable. Also, the reason for setting the maximum amount of erasing exposure Er at $10^3$ lux·sec is because no sensitization is observed with an amount greater than $10^3$ lux·sec.

PHOTOSENSITIVE MEMBER B

Here, a resin binder type photosensitive member using $CdS_xSe_{1-x}\cdot nCdCO_3$($x=0.7$; $n=1$) was prepared.

An aqueous solution containing 308.5 grams of cadmium nitrate and 0.16 grams of cupric chloride was admixed with an aqueous solution of ammonium carbonate to form a precipitate of $CdCO_3$(Cu). Following this, an aqueous solution containing 23.85 grams of ammonium sulfide and 19.5 grams of ammonium selenide was dropped in small amounts into the above solution mixture to thereby obtain a precipitate of $CdS_{0.7}Se_{0.3}\cdot nCdCO_3$. This precipitate was then rinsed, dried, ground and calcined at a temperature of 250° C. for 15 hours to obtain a fine photoconductive powder of $CdS_{0.7}Se_{0.3}\cdot nCdCO_3$. This fine powder was then dispersed, along with a thermosetting acryl resin (Acrylic A 405 available from Dainippon Ink Co.) and xylene solution and the product was then coated onto an aluminum drum, which was 120 mm in diameter, by spraying to provide a thickness of about 30 microns. The heat-curable layer subsequently was heat cured. Over this photoconductive layer, a solution containing xylene and a thermosetting acryl resin was then coated into a thickness of about 1 micron to form an insulating protective layer.

Figure 2:
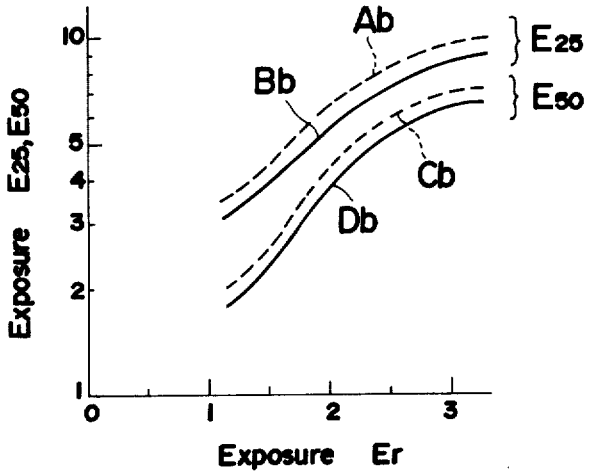

Experiments similar to those used in the case of photosensitive member A were conducted to observe the relationship between the amount of erasing exposure Er and the photosensivity of the photosensitive member B, i.e, the amount of image exposure $E_{25}$ and $E_{50}$ required to light decay the initial surface potential $V_0$ of $\pm 600$ volts to 25% and 50% thereof, respectively. FIG. 2 shows the results, curves Ab and Bb representing the characteristic of $E_{25}$ in the case of positive and negative chargings, respectively, and curves Cb and Db represent the characteristic of $E_{50}$ in the case of positive and negative chargings, respectively. The conditions for the experiments were the same as in the case of photosensitive member A, with the exception that a light source of exposing wavelength of 760 nm was used for image exposure.

As shown by curves Ab and Bb in FIG. 2, when photosensitive member B is given an erasing exposure amount Er of $2\times 10^3$ lux·sec (logarithmic value of 3.3) by the light eraser and is then charged to the initial surface potentials $V_0$ of $+600$ volts and $-600$ volts, respectively, the amount of image exposure $E_{25}$ necessary to light decay the surface potentials of $+600$ volts and $-600$ volts to 25% thereof is about 10 expressed in term of relative value in the case of positive charging and about 9 in the case of negative charging. On the other hand, the amount of image exposure $E_{25}$ necessary is only about 3.3 in the case of positive charging and about 3.1 in the case of negative charging when the photosensitive member is given an erasing exposure amount Er of 13.5 lux·sec (logarithmic value of 1.13) prior to the charging. This means that photosensitive member B is sensitized about three-fold, both in the cases of positive and negative chargings, when the erasing exposure amounts Er of $2\times 10^3$ lux·sec and 13.5 lux·sec are compared, as is apparent from curves Ab and Bb.

Similarly, to light decay the initial surface potentials of +600 volts and −600 volts to 50% thereof, an amount of image exposure $E_{50}$ of about 7 in relative value in the case of positive charging and about 6.5 in the case of negative charging are needed when the erasing exposure amount Er is $2+10^3$ lux·sec, whereas $E_{50}$ is only about 2 in the case of positive charging and about 1.8 in the case of negative charging when the amount of erasing exposure Er is 13.5 lux·sec. Thus, by comparison, the photosensitive member is sensitized as much as three and one-half fold or more, irrespective of the charging polarity. Accordingly, this photosensitive member B also becomes more sensitive as the amount of erasing exposure Er becomes smaller. Since a sensitization of at least twice the original sensitivity is effective, the amount of erasing exposure Er by the light eraser should preferably be about 13 to 40 lux·sec for the photosensitive member B. It should be noted that with an erasing exposure less than 13 lux·sec, the surface potential $V_0$ charged is unstable. Also, the reason for setting the maximum amount of erasing exposure Er at $2+10^3$ lux·sec is because no sensitization is observed with such greater amount.

PHOTOSENSITIVE MEMBER C

Here, a resin binder type photosensitive member was prepared using CdS as the photoconductive material.

A solution comprising 50 parts by weight of thermosetting acrylic resin (Acrylic A 405 available from Dainippon Ink Co.) in 120 parts by weight of an organic solvent mixture consisting chiefly of xylene was added to 100 parts by weight of finely divided CdS(Cu) containing 0.1 atomic % Cu per 100 atomic % Cd. The mixture was thoroughly kneaded and was then applied by spraying onto an aluminum drum which was 120 mm in diameter. Thereafter, the mixture was cured with heating to prepare a photosensitive member D in the form of drum comprising a photoconductive layer about 30 microns in thickness.

Figure 3:
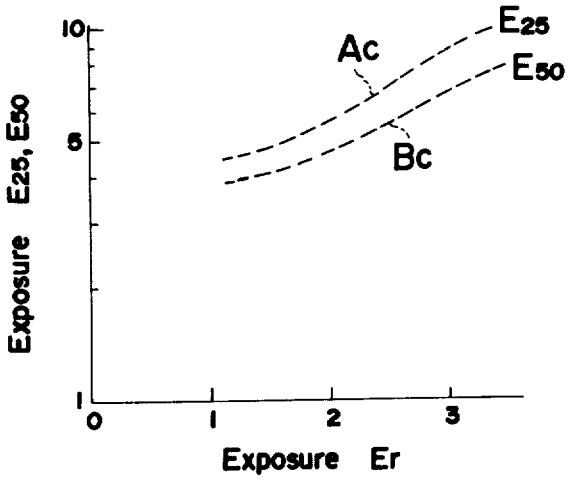

Using this photosensitive member C, experiments were conducted to observe the relationship between the amount of erasing exposure Er and the amount of image exposure $E_{25}$ and $E_{50}$ required to light decay the initial surface potential $V_0$ of −600 volts to 25% and 50% thereof, respectively. In FIG. 3, curve Ac representing the characteristic of $E_{25}$ reveals that when the photosensitive member C is given an erasing exposure amount Er of $3\times10^3$ lux·sec (logarithmic value of 3.48) by the light eraser and is then charged to a surface potential of −600 volts, the amount of image exposure $E_{25}$ necessary to light decay the surface potential of −600 volts to −150 volts is about 10 expressed in term of relative value. On the other hand, the amount of image exposure $E_{25}$ necessary is only about 4.4 when the erasing exposure amount Er is 15 lux·sec (logarithmic value of 1.18). This means that photosensitive member C is sensitized to about twice as much or more processwise.

Similarly, to light decay the initial surface potential of −600 volts to 50% thereof, an amount of image exposure $E_{50}$ of about 8 is needed when the erasing exposure amount Er is $3\times10^3$ lux·sec, whereas only about 3.8 is needed when the amount of erasing exposure Er is 15 lux·sec as shown by curve Bc. Thus, photosensitive member C is sensitized to about twice even in the case of $E_{50}$. Since a senitization of twice or more is effective, the amount of erasing exposure Er by the light eraser should preferably be about 15 to 50 lux·sec for the photosensitive member C.

PHOTOSENSITIVE MEMBER D

Here, a resin binder type photosensitive member was prepared comprising $(CdS)_x(CdSe)_{1-x}\cdot nCdCO_3$ (x=0.4; n=0.5) as the photoconductive material.

An aqueous solution containing 308.5 grams of cadmium nitrate and 0.16 grams of cupric chloride was admixed with an aqueous solution of ammonium carbonate to form a precipitate of $CdCo_3$(Cu). Two solutions containing the same precipitate were prepared. Hydrogen sulfide gas was bubbled through one of the solutions at a rate of 0.5 liter per minute for 12.5 minutes to obtain a precipitate of $CdS\cdot nCdCO_3$, and hydrogen selenide gas was bubbled through the other solution at a rate of 0.5 liter per minute for 18 minutes to obtain a precipitate of $CdSe\cdot nCdCO_3$. Each of these precipitates was rinsed, dried, ground and calcined at a temperature of 250° C. for 15 hours to obtain respective, fine, photoconductive powders of $CdS\cdot nCdCO_3$ and $Cde\cdot nCdCO_3$. 40 grams of $CdS\cdot nCdCO_3$ powder and 60 grams of $CdSe\cdot nCdCO_3$ were then dispersed along with thermosetting acryl resin (Acrylic A 405 available from Dainippon Ink Co.) in xylene to form a solution which then was coated onto an aluminum drum, which was 120 mm in diameter, by spraying to a thickness of about 30 microns. The layer subsequently was heat cured to form a photoconductive layer of $(CdS)_{0.4}(CdSe)_{0.6}\cdot nCdCO_3$.

Figure 4:
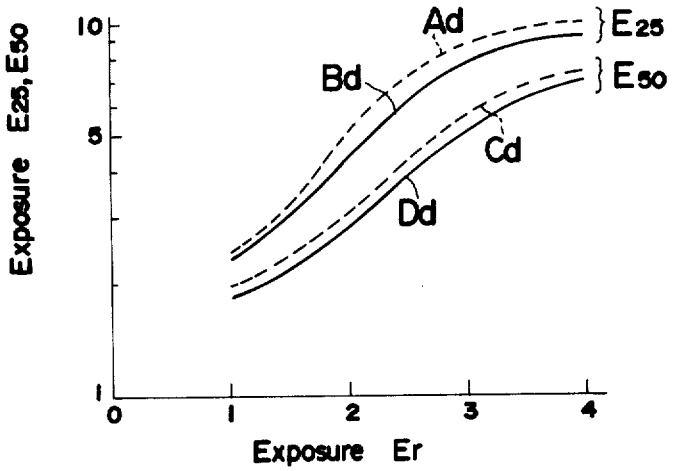

In FIG. 4, which shows the same relationships as FIGS. 1 to 3, curves Ad and Bd represent the characteristic of $E_{25}$ for positive and negative chargings, respectively and Cd and Dd represent the characteristic of $E_{50}$ for positive and negative chargings, respectively. The conditions for the experiments were the same as in the case of photosensitive member B.

As shown by curve Ad and Bd, a photosensitive member D subjected to erasing under an exposure amount Er of $10^4$ lux·sec (logarithmic value of 4) and then charged to initial surface potentials $V_0$ of +600 volts, and −600 volts respectively, required image exposure amounts $E_{25}$ of about 10 (relative value) in the case of positive charging and about 9 in the case of negative charging in order to light decay the surface potentials to 25%. On the other hand, the amounts of image exposure $E_{25}$ are only about 2.5 in the case of positive charging and about 2.3 in the case of negative charging when the photosensitive member is given an erasing exposure amount Er of 10 lux·sec (logarithmic value of 1). Accordingly, the photosensitive member D is sensitized as much as four-fold, irrespective of charging polarity.

Similarly, although image exposure amounts $E_{50}$ of about 7.4 in the case of positive charging and about 7 in the case of negative charging are needed in order to light decay the initial surface potentials of +600 volts and −600 volts to 50% when the photosensitive member is given an erasing exposure amount Er of $10^4$ lux·sec, and an exposure $E_{50}$ of only about 2 in the case of positive charging and only about 1.8 in the case of negative charging is needed when the amount of erasing exposure Er is as small as 10 lux·sec. Thus photosensitive member D is sensitized to just less than four-fold processwise by reducing the amount of erasing exposure Er from $10^4$ lux·sec to 10 lux·sec. Since a sensitization of at least twice is effective for the present invention, the amount of erasing exposure should be about 10 to 100 lux·sec. With an Er of less than 10 lux·sec, the charge accepting capability is reduced and accordingly is not desirable.

Although the photosensitive members A to D, which are useful in the present invention, have low photosensitivities to wavelengths near the infrared zone, the sensitivity is at least doubled by reducing the amount of erasing exposure, and it is in this regard that the image-forming method of the present invention includes the step of uniformly illuminating the photosensitive member with a small amount of exposure. However, the utilization of photosensitive members A to D under highly sensitized conditions using small amounts of erasing exposure Er results in relatively large sensitivity variations in the initial stage of chargings, i.e., in the first several to ten or more rotations of the photosensitive members. In other words, when any one of the photosensitive members is subjected to charging and erasing exposure repeatedly, the surface potential charged in the initial stage undergoes large variations, which in turn cause abrupt variations in the light decay rate caused by the erasing exposure. Explaining this phenomenon with reference to the degree of trap filling described above, charge carriers generated by the erasing exposure in the initial stage of the repeated charging-erasing exposure step will be forced to fill initially empty traps from beginning to end until all traps are filled. This then means that the average lifetime of the charge carriers, i.e. the photosensitivity will vary until the traps are filled completely.

In accordance with the present invention, it has been discovered that the above-described sensitivity variations in the initial stage are stabilized by subjecting the photosensitive member to the prehysteresis steps of charging and erasing exposure a plurality of times. In other words, in the present invention a photosensitive member having a photoconductive layer which is prepared from a dispersion of a photoconductive material including at least cadmium sulfide in a resin binder is subjected to the prehysteresis steps of charging and erasing exposure a plurality of times until the photosensitivity of the photosensitive member is stabilized or made uniform. The member then is utilized to begin actual image formation in its high sensitive condition. The amount of erasing exposure should be relatively small so as to sensitize the photosensitive member and, in particular, the amount of erasing exposure by the light eraser 7 should be about 2 to 20 lux·sec for $CdS{\cdot}nCdCO_3$ ($0<n\leqq 4$) resin binder type photosensitive member A, 13 to 40 lux·sec for $CdS_xSe_{1-x}{\cdot}nCdCO_3$ ($0.1\leqq x<1$; $0<n\leqq 4$) resin binder type photosensitive member B, 15 to 50 lux·sec for CdS resin binder type photosensitive member C and 10 to 100 lux·sec for $(CdS)_x(CdSe)_{1-x}{\cdot}nCdCO_3$ ($0.1\leqq x\leqq 0.99$; $0<n\leqq 4$) resin binder type photosensitive member D. In the actual copying or image-forming mode, the amount of erasing exposure should be kept the same or within the above ranges so that the photosensitive member will be sensitized during every rotation of the member.

Since the prehysteresis steps of charging and erasing exposure a plurality of times successively is performed prior to actual image formation, it is desirable to stabilize the photosensitivity in as short a time as possible. For this purpose, it is best to rotate the photosensitive member at a speed higher than the speed used during the actual image formation and to increase the charging current and erasing light intensity to compensate for the speed increase. To be specific, the photosensitivity of the photosensitive member will be stabilized in one third the time by tripling the rotating speed of the photosensitive member relative to the normal speed used during the actual image formation while also tripling the charging current and the erasing light intensity, but with the erasing exposure amount maintained the same. To obtain similar results, two or more devices of the same construction for effecting the prehysteresis steps of charging and erasing exposure may be provided adjacent one another, and if the rotating speed of the photosensitive member is increased, then the time required to stabilize the photosensitivity will be greatly reduced.

Figure 5:
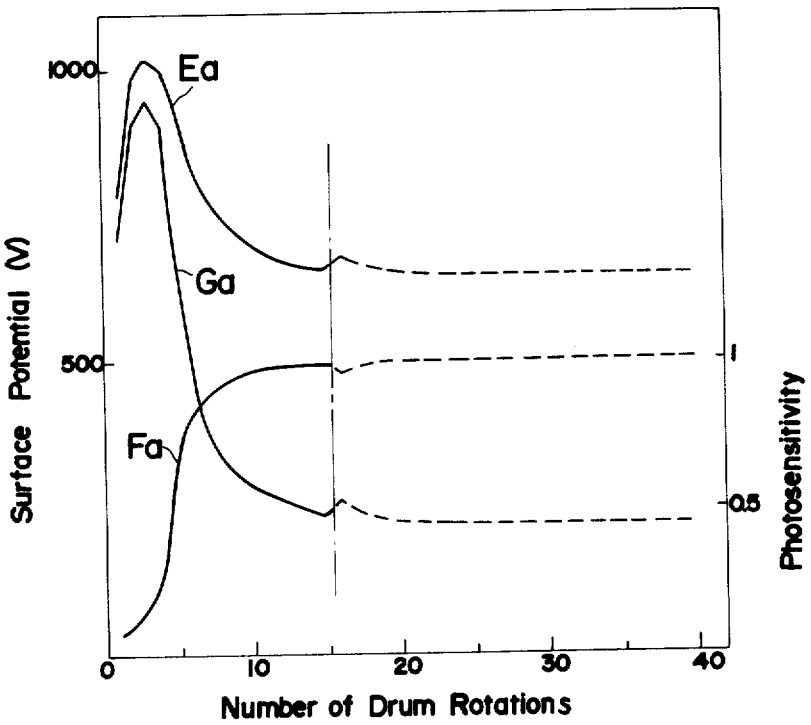
FIGS. 5 and 6 are graphs showing respectively the progress of stabilizing the photosensitivity of the photosensitive member by the method according to the present invention when $CdS{\cdot}nCdCO_3$ or $CdS_xSe_{1-x}{\cdot}nCdCO_3$ is used as the photoconductive material in the photosensitive member.
Figure 7:
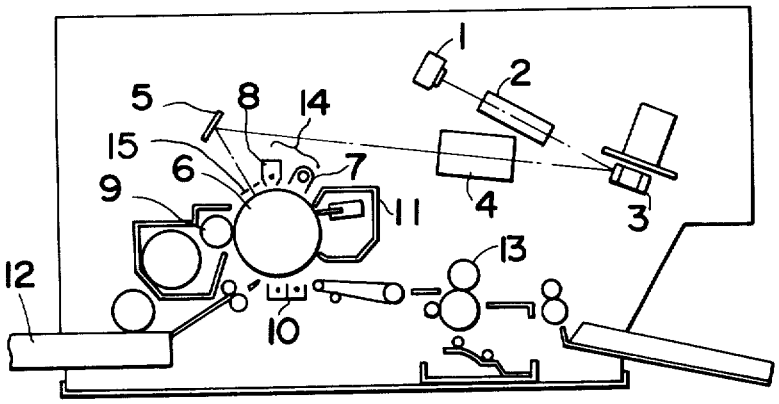
FIG. 7 is a diagrammatic, cross-sectional view of a semiconductor laser beam printer employing an image-forming method in accordance with the present invention.

In FIG. 5, which shows the experimental results of the process of stabilizing the photosensitivity of the $CdS{\cdot}nCdCO_3$ resin binder type photosensitive member A, the left hand ordinate represents the surface potential (volts), the right hand ordinate represents the photosensitivity (relative value) and the abscissa represents the number of rotations of the photosensitive drum. Curve Ea in the drawing shows the variation or change in the initial surface potential, curve Fa shows the photosensitivity variations and curve Ga shows the variation in the light decayed surface potential. In conducting the experiment, a printer as shown in FIG. 7 was used. Photosensitive member 6 was subjected to the prehysteresis steps of repeatedly being subjected to charging by the corona charger 8 and erasing exposure by the light eraser 7, i.e., as the photosensitive member 6 is rotated in the counter-clockwise direction. Photosensitive member 6 was rotated at a speed three times its normal speed with the corona charging current and the erasing exposure intensity each tripled. The amount of erasing exposure was 2.3 lux·sec, which makes the photosensitive member most sensitive as described in the above experiment, and a tungsten lamp was used as the light source for the light eraser. Other elements of the printer remained deenergized.

As can be seen from FIG. 5, curves Ea, Fa and Ga, i.e., initial surface potential charged by the corona charger 8, photosensitivity and light decayed surface potential after exposure by the light eraser 7 undergo great variations during the first few rotations of the photosensitive drum, and as shown by curve Ga in particular, very little light decay occurs and the photosensitivity is substantially zero. As the drum is rotated further, i.e., when the drum has made about 5 to 6 rotations, the initial surface potential (curve Ea), the photosensitivity (Fa) and the light decayed surface potential (Ga) begin to stabilize, and when the drum has made about 15 rotations, all are substantially stabilized. This mean that by repeating the prehysteresis steps of subjecting the photosensitive member to charging by the corona charger and to erasing exposure by the light eraser about 15 times, the photosensitivity of the photosensitive member A is stabilized so that the image-forming characteristics thereof are quite good.

Explaining the reason for such stabilization of photosensitivity, it has been described that this photosensitive member A as well as other the photosensitive members B, C and D have numerous traps in the photoconductive layer. When the surface of the photosensitive member is charged uniformly by the corona charger 8 and is then exposed to the light eraser 7, charger carriers will be generated in the photoconductive layer, and some of them will migrate toward the conductive substrate to escape therefrom. However, since there are numerous traps, many of the charge carriers will be trapped. This then means there will be little if any light decay and thus hardly any photosensitivity. When the charging and erasing exposure steps are repeated, more traps will be filled to thus gradually improve the photosensitivity of the member, and when the traps are completely filled, the photosensitivity will be the greatest since any further charge carriers will be able to migrate to escape to the substrate since all the traps are already filled. In the case of photosensitive member A, about 15 rotations of the drum, i.e., about 15 repetitions of the prehysteresis steps, will result in filling the traps to stabilize the photosensitivity.

Following the repetition of the prehysteresis steps about 15 times, the rotating speed of the photosensitive member A is reduced to its normal speed (one third of the speed used during prehysteresis) to effect actual image formation successively by projecting the information from the laser 1. During such image formation, the initial surface potential, the photosensitivity and the light decayed surface potential are all stable, thereby assuring reproduction of fine images. Although a small variation in each of these characteristics is observed when the rotating speed of the photosensitive member is changed from triple to normal speed, such variation is negligible as far as the quality of the reproduced image is concerned.

Figure 6:
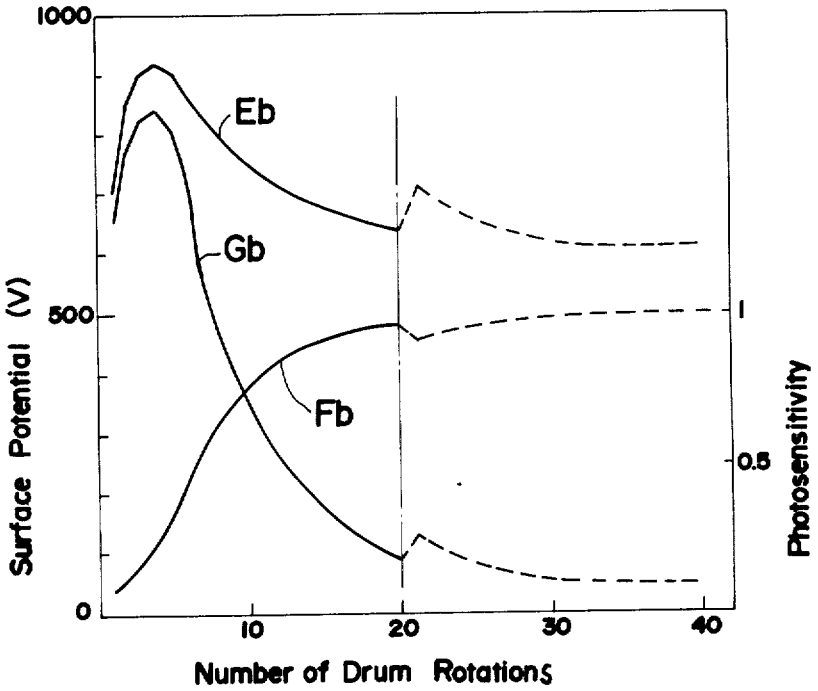

FIG. 6 shows the experimental results similar to FIG. 5, but in this case for the $CdS_{0.7}Se_{0.3}\cdot nCdCO_3$ resin binder type photosensitive member B and positive charging. Curves Eb, Fb and Gb respectively represent the variation of initial surface potential, photosensitivity and light decayed surface potential. Conditions for the experiment were the same as with the case of $CdS\cdot nCdCO_3$ resin binder type photosensitive member A, with the exception of the amount of erasing exposure by the light eraser 7, which was set to be 13.5 lux·sec. As is set forth above in the examaple of photosensitive member B, an erasing exposure of 13.5 lux·sec wil make the photosensitive member B most sensitive.

The results are quite similar to FIG. 5, and as shown by curves Eb, Fb and Gb, the initial surface potential charged by the corona charger 8, the photosensitivity and the surface potential after exposure by the light eraser 7 undergo great variations during the first few rotations of the drum, and the photosensitivity is substantially zero. As the photosensitive drum is further rotated, and when it has rotated for about 20 rotations, i.e, when the prehysteresis steps of charging and erasing exposure have been repeated sequentially for about 20 times, all of the characteristics are substantially stabilized and the photosensitive member is ready for actual image formation. At this point of in time, the rotating speed is reduced to one third to begin the image formation. Although again small variations in each of the characteristics are observed when the rotating speed is changed, such variations are negligible and the first few images obtained had the same fine quality as succeeding images.

Even in the case of negative charging, the photosensitivity of photosensitive member B is stabilized by repeating the prehysteresis steps about 20 times. Although not shown, similar experiments were conducted for CdS resin binder type photosensitive member C using negative charging and for $(CdS)_{0.4}(CdSe)_{0.6}\cdot nCdCO_3$ resin binder type photosensitive member D using both positive and negative chargings. The experiments revealed that about 15 rotations, i.e., 15 repetitions of the prehysteresis steps for photosensitive member C and about 20 to 25 repetitions, irrespective of charging polarity, for photosensitive member D, were required to stabilize the photosensitivity. All things considered, at least ten repetitions of the prehysteresis steps of charging and erasing exposure prior to the image formation are preferable, and generally no more than thirty repetitions of the prehysteresis steps are required for any of the photosensitive members A, B, C and D. At any rate, it is sufficient to sequentially repeat the prehysteresis steps until all traps are substantially filled. In addition, it should be noted that the amount of erasing exposure Er will vary somewhat depending on the measuring device used to measure the amount, on the type of light source and the color and temperature thereof, and on various other factors, and may often cause errors of up to about 50%. Accordingly, the upper and lower limit values will range up to as much as ±50% at maxiumum so that the amount of erasing exposure Er for photosensitive member A, which was described above as being 2 to 20 lux·sec, may be as low as 1 lux·sec and as high 30 lux·sec. For the same reason, the Er may range from 6.5 to 60 lux·sec for photosensitive member B, from 7.5 to 75 lux·sec for photosensitive member C and from 5 to 150 lux·sec for photosensitive member D.

FIG. 7 shows an embodiment of a laser beam printer employing the image-forming method of the present invention and using a semiconductor laser as an image exposure source. The printer includes semiconductor laser 1 with an exposure wavelength of 700 to 850 nm, a converting optical unit 2, a multi-facet mirror 3, and F-$\theta$ lens system 4 and a reflecting mirror 5. In projecting an image successively onto the photosensitive drum 6 rotating in the counter-clockwise direction, a beam from the semiconductor laser 1, which is modulated (ON-OFF) by image signals, is converted by the converting optical unit 2 and is then scanned by the multi-facet mirror 3 in the length-wise direction of the photosensitive drum. While the foregoing occurs, the compensation of scanning rate and image focussing are effected by the F-$\theta$ lens 4 for successive projection onto the photosensitive drum 6 through the reflecting mirror. As has been described above, photosensitive drum 6 includes a photoconductive layer which is prepared from a dispersion of a photoconductive material including at least cadmium sulfide in a resin binder. Arranged sequentially around the photosensitive drum 6, and in the rotating direction thereof, are a light eraser 7 for uniformly exposing the surface of the drum, a corona charger 8 for uniformly charging the drum, an exposure slit through which an image is projected onto the drum, a magnetic brush developing device 9 for developing an electrostatic latent image, an image-transferring corona charger 10 for transferring the developed image onto a transfer paper and a cleaning blade 11 for removing residual toner. Transfer papers are stored in a cassette, fed one by one for transfer by the corona charger 10 and discharged out of the printer after heat fixing by a pair of fixing rollers 13.

While the light eraser 7 and the corona charger 8 function to erase residual charges and to uniformly charge the surface of the drum during the image-forming mode, together they cooperate as a pair or as a unit to 7 form a prehysteresis device 14 to sequentially perform the prehysteresis steps of subjecting the photosensitive member to charging by the corona charger 8 and to erasing exposure by the light eraser 7 prior to image formation to thus stabilize the photosensitivity of photosensitive drum 6. The amount of erasing exposure provided by the light eraser 7 should be relatively small, as described in connection with FIGS. 1 to 4, and preferably should be about 2 to 20 lux·sec when a $CdS \cdot nCdCO_3$ resin binder type photosensitive member A is used, about 13 to 40 lux·sec when a $CdS_xSe_{1-x} \cdot nCdCO_3$ ($0.1 \leqq x < 1$) resin binder type photosensitive member B is used, about 15 to 50 lux·sec when a CdS resin binder type photosensitive member C is used and about 10 to 100 lux·sec when a $(CdS)_x(CdSe)_{1-x} \cdot nCdCO_3$ resin binder type photosensitive member D is used. To shorten the time required for repetition of the prehysteresis steps by the prehysteresis device 14, the photosensitive drum 6 is adapted to be driven at a faster speed during the prehysteresis step. Instead or, in addition thereto, a plurality of pairs of prehysteresis devices 14 may be provided adjacent one another.

In operation, photosensitive drum 6 is rotated at a high speed, e.g., at a speed three times the image-forming speed, and simultaneously therewith, the light eraser 7 and the corona charger 8, i.e., the prehysteresis device 14, are energized to effect the prehysteresis steps of charging and erasing exposure. These steps are repeated, i.e., the drum 6 is rotated, until the photosensitivity thereof is substantially stabilized. In the case of $CdS \cdot nCdCO_3$ resin binder type photosensitive member A, the prehysteresis steps are repeated for about 15 times as described in connection with FIG. 5. When the photosensitivity is substantially stabilized, the rotating speed of the drum 6 is reduced to one third to begin the successive image formation. An image is formed on the drum 6 by image exposure by the laser 1 after uniform charging by the corona charger 8, and this image is then developed by developing device 9 and is transferred onto the transfer paper. After the transfer, the drum 6 is subjected to removal of residual toner by the cleaning blade 11 and to erasing of residual charges by the light eraser 7. This sequence is repeated until the desired number of images are formed. When the printer is brought to a rest and if new images are to be formed, the prehysteresis steps are repeated again to stabilize the photosensitivity. If the rest time is extremely short, such as only about 10 seconds or so, the prehysteresis steps are not particularly necessary since most of traps are still filled. Or it may be that only a few repetitions of the prehysteresis steps are sufficient.

Figure 8:
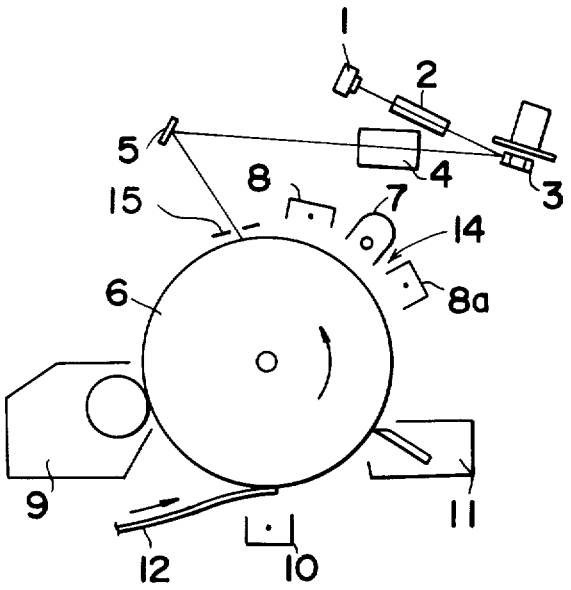
FIG. 8 is a diagrammatic cross-sectional view of a modified laser beam printer employing an image-forming method in accordance with the present invention.

FIG. 8 shows another embodiment of the present invention in which another corona charger 8*a* is provided adjacent the light eraser 7 and upstream thereof. In this case, the corona charger 8*a* together with the light eraser 7 form a prehysteresis device 14 for performing the prehysteresis steps of charging and erasing exposure. Instead of corona charger 8*a*, the transfer corona charger 10 may be used to form a part of the prehysteresis device 14.

While there have been described preferred embodiments of the present invention, additions and ommissions may be made without departing from the spirit thereof.

I claim:

1. An image-forming method which comprises: sequentially subjecting a photosensitive member to a plurality of prehysteresis operations, each comprising electrostatically charging said member and thereafter uniformly exposing the same to light until the photosensitivity of the photosensitive member is substantially stabilized, said photosensitive member comprising a photoconductive layer prepared from a dispersion of a photoconductive material including cadmium sulfide in a resin binder formed over a conductive substrate; and subsequently forming successive images with said member.

2. An image-forming method as claimed in claim 1 wherein said photoconductive material is selected from the group consisting essentially of $CdS \cdot nCdCO_3$ ($0 < n \leqq 4$), $CdS_xSe_{1-x} \cdot nCdCO_3$ ($0.1 \leqq x < 1$; $0 < n \leqq 4$), CdS and $(CdS)_x(CdSe)_{1-x} \cdot nCdCO_3$ ($0.1 \leqq x < 0.99$; $0 < n \leqq 4$).

3. In an image-forming method suitable for image exposure under wavelengths of about 700 to 850 nm, the steps of using a photosensitive member including a photoconductive layer formed over a conductive base, said layer having been prepared from a dispersion of a photoconductive material selected from the group consisting essentially of (a) $CdS \cdot nCdCO_3$ ($0 < n \leqq 4$), (b) $CdS_xSe_{1-x} \cdot nCdCO_3$ ($0.1 \leqq x < 1$; $0 < n \leqq 4$), (c) CdS and (d) $(CdS)_x(CdSe)_{1-x} \cdot nCdCO_3$ ($0.1 \leqq x \leqq 0.99$; $0 < n \leqq 4$) in a resin binder; sequentially subjecting said photosensitive member to a plurality of prehysteresis operations, each comprising electrostatically charging said member and thereafter uniformly exposing the same to light until the photosensitivity of the photosensitive member is substantially stabilized, the amount of said uniform light exposure being in the range of from about 1 to about 30 lux·sec when said photoconductive material (a) is used, about 6.5 to about 60 lux·sec when said photoconductive material (b) is used, about 7.5 to about 75 lux·sec when said photoconductive material (c) is used, and about 5 to about 150 lux·sec when said photoconductive material (d) is used; and subsequently forming successively images on the member by uniform charging and image exposure.

4. An image-forming method as claimed in claim 3 wherein said prehysteresis steps are effected by a prehysteresis device comprising a light eraser for said uniform exposure to light and a corona charger for said electrostatic charging.

5. An image-forming method as claimed in claim 4 wherein said photosensitive member is rotated at a first speed during said prehysteresis steps and then at a reduced normal speed during image formation.

6. An image-forming method as claimed in claim 4 or 5 wherein more than one of said prehysteresis devices are used.

7. An image-forming method as claimed in claim 3 wherein the amount of uniform exposure is in the range of from about 2 to about 20 lux·sec when said photoconductive material (a) is used, about 13 to about 40 lux·sec when said photoconductive material (b) is used, about 15 to about 50 lux·sec when said photoconductive material (c) is used, and about 10 to about 100 lux·sec when said photoconductive material (d) is used.

8. In an image-forming method suitable for use in connection with a semiconductor laser beam printer, the steps of:

using a photosensitive member including a photoconductive layer formed over a conductive substrate, said layer having been prepared from a dispersion of a photoconductive material selected from the group consisting essentially of (a) $CdS \cdot nCdCO_3$ ($0 < n \leqq 4$), (b) $CdS_xSe_{1-x} \cdot nCdCO_3$ ($0.1 \leqq x < 1$; $0 < n \leqq 4$), (c) CdS and (d) $(CdS)_x(CdSe)_{1-x} \cdot nCdCO_3$ ($0.1 \leqq x \leqq 0.99$; $0 < n \leqq 4$) in a resin binder;

sequentially subjecting said photosensitive member while rotating the same to a plurality of prehysteresis operations, each comprising electrostatically charging said member and uniformly exposing the same to light until the photosensitivity of the photosensitive member is substantially stabilized, the amount of said uniform exposure being in the range of from about 2 to about 20 lux·sec when said photoconductive material (a) is used, about 13 to about 40 lux·sec when said photoconductive material (b) is used, about 15 to about 50 lux·sec when said photoconductive material (c) is used, and about 10 to about 150 lux·sec when said photoconductive material (d) is used; and then subjecting said photosensitive member to successive image forming steps, each including the steps of charging the photosensitive member, exposing the charge member to an image and transferring the image thus formed onto a transfer paper.

9. An image-forming method as claimed in claim 8 wherein said prehysteresis operation is repeated at least 10 times using a device including a light source and a charging means.

10. An image-forming method as claimed in claim 9 wherein said photosensitive member is rotated at a first speed during the repetition of said prehysteresis step and at a reduced speed during image formation.

* * * * *